United States Patent [19]

Parekh

[11] Patent Number: 4,543,106

[45] Date of Patent: Sep. 24, 1985

[54] COATED ABRASIVE PRODUCT CONTAINING HOLLOW MICROSPHERES BENEATH THE ABRASIVE GRAIN

[75] Inventor: Dhan N. Parekh, Williamsville, N.Y.

[73] Assignee: Carborundum Abrasives Company, Niagara Falls, N.Y.

[21] Appl. No.: 623,979

[22] Filed: Jun. 25, 1984

[51] Int. Cl.[4] ..... B24D 3/32; B24D 3/34; B24D 11/02

[52] U.S. Cl. ..... 51/295; 51/296; 51/298; 428/143; 428/240; 428/241; 428/248; 428/252; 428/283; 428/313.5; 428/313.9; 428/332; 428/339

[58] Field of Search ..... 428/143, 240, 241, 248, 428/252, 283, 313.5, 313.9, 332, 339; 51/295, 296, 298

[56] References Cited

U.S. PATENT DOCUMENTS

| | | | |
|---|---|---|---|
| 2,986,455 | 5/1961 | Sandmeyer | 51/296 |
| 3,502,453 | 3/1970 | Baratto | 51/295 |
| 3,661,544 | 5/1972 | Whitaker | 51/298 |
| 3,778,241 | 12/1973 | Winter et al. | 51/298 |
| 3,787,273 | 1/1974 | Okrepkie et al. | 51/298 |
| 3,925,034 | 12/1975 | Anna et al. | 51/296 |
| 3,928,949 | 12/1975 | Wagner | 51/298 |
| 4,035,961 | 7/1977 | Pemrick et al. | 51/295 |
| 4,111,667 | 9/1978 | Adams | 428/269 |
| 4,132,533 | 1/1979 | Lohmer et al. | 51/298 |

*Primary Examiner*—James C. Cannon

*Attorney, Agent, or Firm*—Michael L. Dunn; Donald C. Studley

[57] ABSTRACT

A coated abrasive product which comprises a fabric backing, a layer of abrasive grain and at least one layer of resin between the backing and abrasive grain. Hollow microspheres are present and at least partly and usually entirely embedded in the resin layer. In general, such hollow microspheres comprise hollow spherical bodies which may be of glass or plastic materials such as a phenolic resin, which have a diameter of from about 5 to about 500 microns and an average diameter of from about 25 to about 150 microns. Such hollow microspheres generally have a shell thickness which averages from about 5 to about 20 percent of the diameter of the microsphere. Such microspheres are usually incorporated into the resin layer in an amount of from about 5 to about 20 percent by weight of the resin layer.

The invention further includes a process for manufacturing a coated abrasive product which comprises coating a fabric backing with a resin followed by application of abrasive grain to the resin wherein hollow microspheres are incorporated into the resin coating.

16 Claims, 3 Drawing Figures

Figure 1:
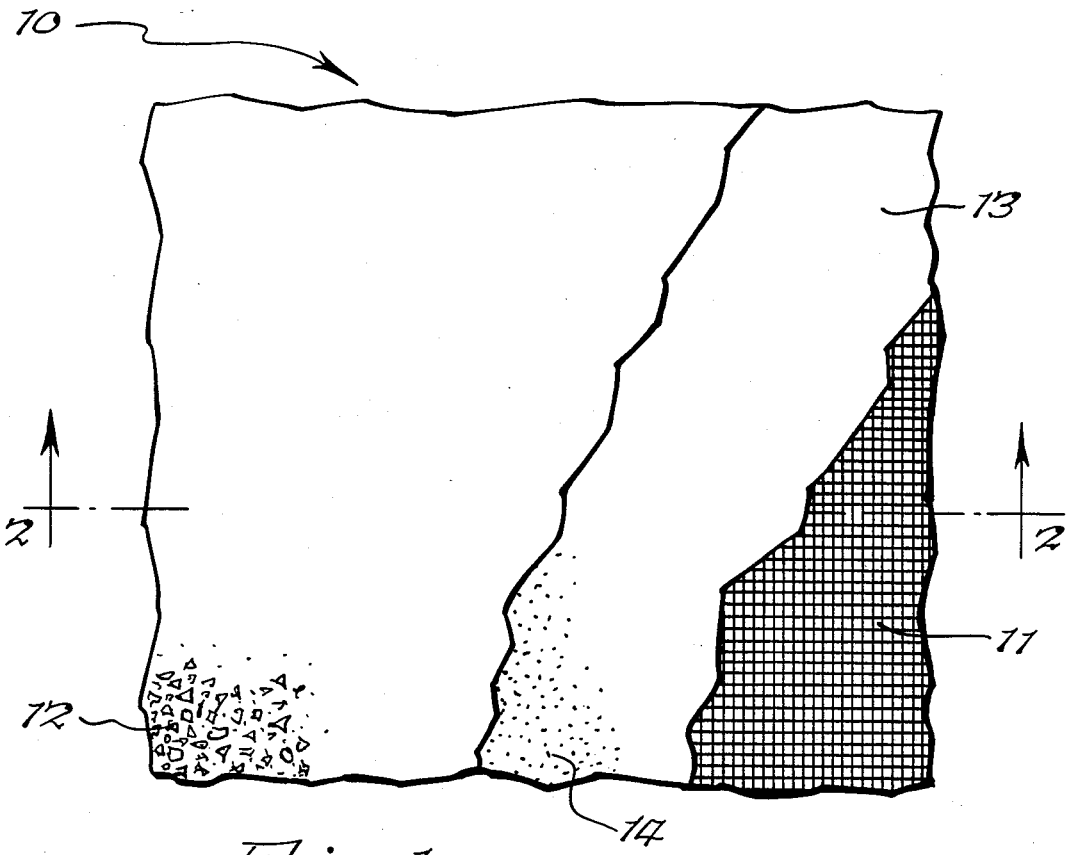

COATED ABRASIVE PRODUCT CONTAINING HOLLOW MICROSPHERES BENEATH THE ABRASIVE GRAIN

BACKGROUND OF THE INVENTION (A) Field of the Invention

This invention relates to coated abrasive products comprising a fabric backing, a resin coating or coatings and abrasive grain embedded in the resin. More particularly, the invention relates to such coated abrasive products for use in heavy duty applications.

(B) History of the Prior Art

In the prior art it has been highly desirable to manufacture coated abrasive products having tear, body and strength as high as is practical. While coated abrasives have been made in the prior art having acceptable tongue tear, body and strength, such characteristics were nevertheless not as high as desired for certain applications. In particular, in heavy duty applications, especially when the coated abrasives involved contain coarse grits (grit size 60 and coarser). One reason for failure of the product occured because of grain shedding and excessive flexing in certain severe grinding operations. Another method of failure in such heavy duty applications as in abrasive belts, is that such coated abrasives do not retain body stiffness for a period as long as desirable. For these reasons, such heavy duty belts fold and then tear or split in the running direction in heavy duty use. Furthermore, such belts in the prior art did not have impact resistance and resistance to thermal stress as high as desirable in either abrasive belts or abrasive discs, and resin coatings would frequently crack which often caused excessive water absorption in the products in wet applications.

It had been known in the prior art that resin sizes could be applied to the back of coated abrasive products which backsizes contained microspheres or microballoons to improve the durability of product in use and to aid in the making of lapped belt joints in the backing. Unfortunately, the incorporation of microspheres in the backsize resin coating did not significantly improve impact resistance and resistance to thermal stress. Furthermore, the improvement in retained body stiffness and tongue tear was not as high as desirable. In addition, there was no significant improvement in cracking of the maker or size resin coating. Such incorporation of microspheres in backsize coatings is disclosed in U.S. Pat. No. 4,111,667.

As used herein, it is understood that "backsize" means a resin coating applied to a fabric backing on the side of the fabric opposite the side upon which abrasive grains are applied. A "size" coating as used herein refers to a frontsize coating which is applied to the fabric on the front of the fabric. The front of fabric refers to that side of the fabric to which abrasive grain is ultimately applied. A "maker coat" means the coating applied to the fabric, whether sized or unsized, which ultimately holds the abrasive grain.

DESCRIPTION OF THE INVENTION

In accordance with the present invention, there is provided a coated abrasive product which comprises a fabric backing, a layer of abrasive grain and at least one layer of resin between the backing and abrasive grain wherein hollow microspheres are present and at least partly and usually entirely embedded in the resin layer. In general, such hollow microspheres comprise hollow spherical bodies which may be of glass or plastic materials such as a phenolic resin, which have a diameter of from about 5 to about 500 microns and an average diameter of from about 25 to about 150 microns. Such hollow microspheres generally have a shell thickness which averages from about 5 to about 20 percent of the diameter of the microsphere. Such microspheres are usually incorporated into the resin layer in an amount of from about 5 to about 20 percent by weight of the resin layer.

The invention further includes a process for manufacturing a coated abrasive product which comprises coating a fabric backing with a resin followed by application of abrasive grain to the resin wherein hollow microspheres are incorporated into the resin coating. Such microspheres are as previously described.

It has been discovered that the incorporation of hollow microspheres into the intermediate resin layer which may be a size coat of resin, a maker coat of resin, or combinations thereof, results in improved strength in bonding between the fabric and the resin when the spheres are in the size coat and further results in improved bond strength between the resin and the grain when the microspheres are incorporated into the maker coat. In addition, the incorporation of such microspheres results in improved tongue tear, body, and coated abrasive strength so that tears or splits are less likely to occur in the running direction of a belt in heavy duty applications. In addition, the backing is protected by the insulating characteristics of the microspheres which increases resistance of the coated abrasive product to thermal stress in heavy duty applications. Such insulating characteristics occur whether the coated abrasive product is in the form of a belt or a disc. Additionally, the incorporation of microspheres into the size coat, maker coat or combinations thereof tend to reduce cracking of the maker and size coats and increases impact resistance.

The fabric backing utilized in coated abrasive products in accordance with the present invention can be conventionally-used backings such as sateen, knit-type or stitch bonded fabrics. The filaments used in the manufacture of the fabric, whether monofilaments, threads or yarns, may comprise any natural or synthetic fiber suitable for such applications. Commonly, cotton fiber or polyester fiber is used.

In the manufacture of coated abrasive products in accordance with the present invention, conventional techniques of applying size and maker adhesives to the backing, followed by application of grain and abrasive size coatings, are used. An example of a suitable maker coat would comprise about 45 weight percent phenolic resin, 45 weight percent of a filler such as calcium carbonate and most of the balance being hollow microspheres. Minor amounts, e.g. usually less than 2 percent, of other ingredients such as colorants, e.g. black dye or wetting agents, e.g. sorbitan monolaurate, may also be incorporated into the maker coat. The hollow microspheres may, for example, comprise silica-alumina hollow glass spheres having a specific gravity of about 0.7, a bulk density of about 25 lbs. per cubic foot, a shell thickness of approximately 10 percent of the diameter of the glass sphere and an average particle size of about 100 microns. Such hollow microspheres are available from P. A. Industries under the trademark Extendospheres. Optionally such microspheres may be coated with a resin or other organic material to enhance compatability and adhesion. "Spheres" or "spherical" as used herein is intended to include particles having a true spherical shape as well as curved surface particles which vary from true spheres by a factor of as much as 0.5 calculated by smallest diameter/largest diameter.

Such a maker coat, as previously described, is applied to a size fabric backing followed by application of abrasive grain and an abrasive size coat following conventional procedures. The maker coat is cured in a usual manner such as by the application of heat.

Figure 2:
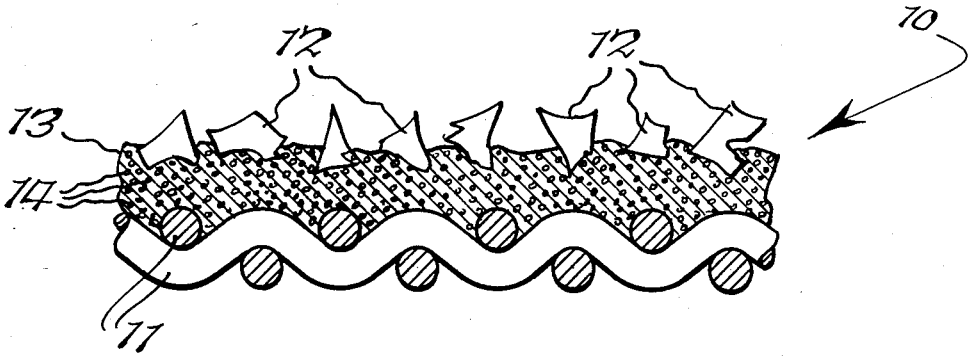
Figure 3:
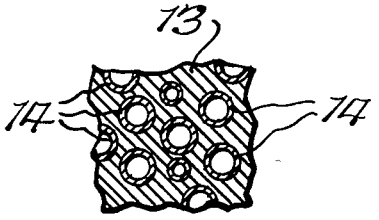

In reference to the drawings,

FIG. 1 is a fragmentary plan view of a coated abrasive product in accordance with the present invention, FIG. 2 is a section thereof taken on lines 2—2 of FIG. 1, and FIG. 3 is a greatly enlarged sectional view of the resin and hollow microspheres taken through the centers of the microspheres.

As seen in the drawings, which illustrate an embodiment of invention, a coated abrasive product 10 is provided which has a fabric backing 11, a layer of abrasive grain 12 and a resin layer 13 between backing 11 and grain 12. Resin layer 13 contains hollow microspheres 14 embedded therein.

As previously discussed, such microspheres improve the characteristics of the coated abrasive product by providing impact resistance, resistance to thermal stress by insulating the abrasive grain surface from the fabric backing, improved adhesion between the fabric and the resin and between the abrasive grain and the resin, improved body stiffness for a longer period of time, improved tear properties and improved resistance to cracking of the resin coating. Furthermore, as a result of the improved adhesion general strength properties of the coated abrasive product are improved.

What is claimed is:

1. In a coated abrasive product which comprises a fabric backing, a layer of abrasive grain and at least one layer of resin between said backing and abrasive grain; the improvement which comprises the presence of hollow microspheres at least partly embedded in said resin layer.

2. The coated abrasive product of claim 1 wherein the hollow microspheres comprise hollow glass spheres having a diameter of from about 5 to about 500 microns.

3. The coated abrasive product of claim 2 wherein the average diameter of the microspheres is from about 25 to about 150 microns.

4. The coated abrasive product of claim 3 wherein the shell thickness of said microspheres averages from about 5 to about 20 percent of the diameter.

5. The coated abrasive product of claim 1 wherein the hollow microspheres comprise hollow phenolic resin spheres having an average diameter of from about 25 to about 150 microns.

6. The coated abrasive product of claim 1 wherein the product is an abrasive belt.

7. The coated abrasive product of claim 1 wherein the product is an abrasive disc.

8. The coated abrasive product of claim 1 wherein the microspheres comprise from about 5 to about 20 percent by weight of the resin layer.

9. In a process for manufacturing a coated abrasive product which comprises coating a fabric backing with a resin followed by application of abrasive grain to the resin, the improvement which comprises incorporating hollow microspheres into said resin coating.

10. The process of claim 9 wherein the hollow microspheres comprise hollow glass spheres having a diameter of from about 5 to about 500 microns.

11. The process of claim 10 wherein the average diameter of the microspheres is from about 25 to about 150 microns.

12. The process of claim 11 wherein the shell thickness of said microspheres averages from about 5 to about 20 percent of the diameter.

13. The process of claim 9 wherein the hollow microspheres comprise hollow phenolic resin spheres having an average diameter of from about 25 to about 150 microns.

14. The process of claim 9 wherein the product is an abrasive belt.

15. The process of claim 9 wherein the product is an abrasive disc.

16. The process of claim 9 wherein the microspheres comprise from about 5 to about 20 percent by weight of the resin layer.

* * * * *